US005082183A

United States Patent [19]

Dahlin et al.

[11] Patent Number: 5,082,183

[45] Date of Patent: * Jan. 21, 1992

[54] SPRAY NOZZLE SELECTOR DEVICE

[76] Inventors: Dale L. Dahlin, 632 North Mountainview, Edward D. Dahlin, 3110 Carmichael #4, both of Moscow, Id. 83843

[ * ] Notice: The portion of the term of this patent subsequent to Sep. 26, 2006 has been disclaimed.

[21] Appl. No.: 551,090

[22] Filed: Jul. 11, 1990

[51] Int. Cl.[5] ..... A62G 31/02

[52] U.S. Cl. ..... 239/393

[58] Field of Search ..... 239/390, 392, 393, 394; 137/270, 556

[56] References Cited

U.S. PATENT DOCUMENTS

| | | | |
|---|---|---|---|
| 2,702,178 | 2/1955 | Scholl | 251/159 |
| 3,094,283 | 6/1963 | Balister | 239/393 |
| 3,326,232 | 6/1967 | Stamps et al. | 251/207 |
| 3,516,611 | 6/1970 | Piggot | 239/394 X |
| 3,558,100 | 1/1971 | Hulsey | 251/207 |
| 3,893,927 | 7/1975 | Cronfel | 210/418 |
| 4,036,435 | 7/1977 | Pecaro | 239/570 X |
| 4,161,307 | 7/1979 | Clinch et al. | 251/206 |
| 4,373,548 | 2/1983 | Chou | 137/460 |
| 4,446,887 | 5/1984 | Redmon et al. | 137/556 |
| 4,582,084 | 4/1986 | Gyurovits | 137/493.8 |
| 4,679,768 | 7/1987 | Hardy | 251/159 |
| 4,869,285 | 9/1989 | Dahlin et al. | 137/270 |

*Primary Examiner*—Andres Kashnikow
*Assistant Examiner*—Kevin Weldon
*Attorney, Agent, or Firm*—Wells, St. John & Roberts

[57] ABSTRACT

A flow selector device 10 makes use of a cover member 59 rotatably mounted to a base member 21. The cover member 59 includes a plurality of exposed, outwardly oriented flow control nozzles 14 spaced about its external parametrial wall 62. The cover 59 spans the base 21 which includes a fluid conduit 32 formed therein for connection to a source of fluid 11. The cover 59 is selectively rotated to bring any one of the nozzles 14 therein into alignment with an open end 34 of the conduit. A clamp device 43 and seal 48 is manually operable to securely clamp the seal 48 against a selected nozzle 14, such that fluid will flow from the source 11 through the conduit 32 and out through the selected nozzle 14 without leakage about the seal 48. The clamp device 43 is also operable to release clamping pressure and thereby allow selective rotation of the cover 59 to bring another selected nozzle 14 into alignment with the conduit 32.

8 Claims, 4 Drawing Sheets

SPRAY NOZZLE SELECTOR DEVICE

TECHNICAL FIELD

The present invention relates to discharge nozzle selector devices and more particularly to such devices that control fluid discharge by selectively positionable nozzles on the perimeter of a base connected to a fluid supply.

BACKGROUND OF THE INVENTION

There has existed a considerable problem, for example in agricultural spraying tasks, relating to use of various spray nozzles for selectively adjusting volume and spray pattern for various selected materials being dispensed. Different chemicals require different application rates and or spray patterns. Flow of the chemical may be controlled, at least in part, by changing the spray nozzle size. In conventional agricultural sprayers; in order to change the flow, it is necessary to remove and replace each of the many nozzles along the spray tube. This is a tedious process and involves a considerable amount of time and frustration. The small nozzles are relatively difficult to handle and, in adverse conditions, can easily be dropped and lost. Often, rather than change out the nozzles, a farmer will risk inaccurate application of chemicals, simply to save time and the frustration of repeatedly changing and re-changing the nozzles.

It therefore becomes desirable to obtain some form of device that will facilitate quick changing of spray nozzles without tedious disassembly and replacement of individual nozzles.

Various apparatus have been developed which including orifice selection capability. However, these apparatus are typically "in line" rather than at an end of a fluid line and so do not lend themselves for use as nozzle selectors. They also usually require relatively elaborate sealing procedures in order to prevent leakage of fluid from the vicinity of the orifice selection mechanism. Furthermore, many of these apparatus are relatively complex and may not be easily disassembled for cleaning or repair.

An example of a very useful flow selector device is disclosed in our U.S. Pat. No. 4,869,285. The device is used for placing a selected restriction in the form of a selected orifice in a single fluid flow line. The device makes use of a housing interrupting the fluid line. The housing includes an internal chamber in which an internal annular orifice plate is mounted, with a plurality of flow control orifices spaced about its perimeter. The plate is sealed within the housing. The internal orifice plate may be selectively rotated to bring any one of its orifices into alignment with the fluid passage through the housing. A clamping arrangement is also provided within the sealed housing to securely clamp the internal orifice plate between seals with the selected orifice in line with and completing the fluid flow line. The clamp device is also operable to release clamping pressure and allow selective rotation of the internal orifice plate to bring a selected orifice into alignment with the fluid line.

While our patented device functions well for flow control within a single flow line, the internal orifice plate and single discharge do not lend themselves to use for multiple discharge externally exposed nozzles. A need has therefor remained for a device that will eliminate the need to individually interchange multiple external exposed nozzles along a fluid supply line.

BRIEF DESCRIPTION OF THE DRAWINGS

A preferred embodiment of the present invention is illustrated in the accompanying drawings, in which:

FIG. 10 is a sectional view taken along line 10—10 in FIG. 2; and

DETAILED DESCRIPTION OF THE PREFERRED EMBODIMENT

Figure 1:
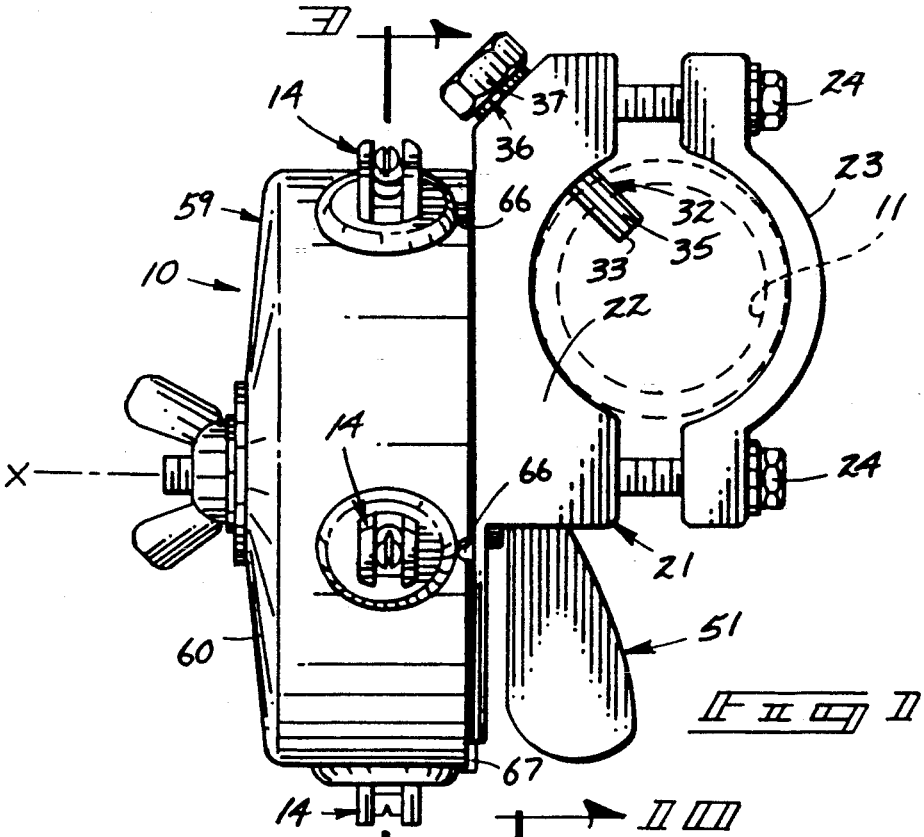
FIG. 1 is a side elevation view of the present invention with a transverse section of a delivery tube shown in dashed-lines.
Figure 2:
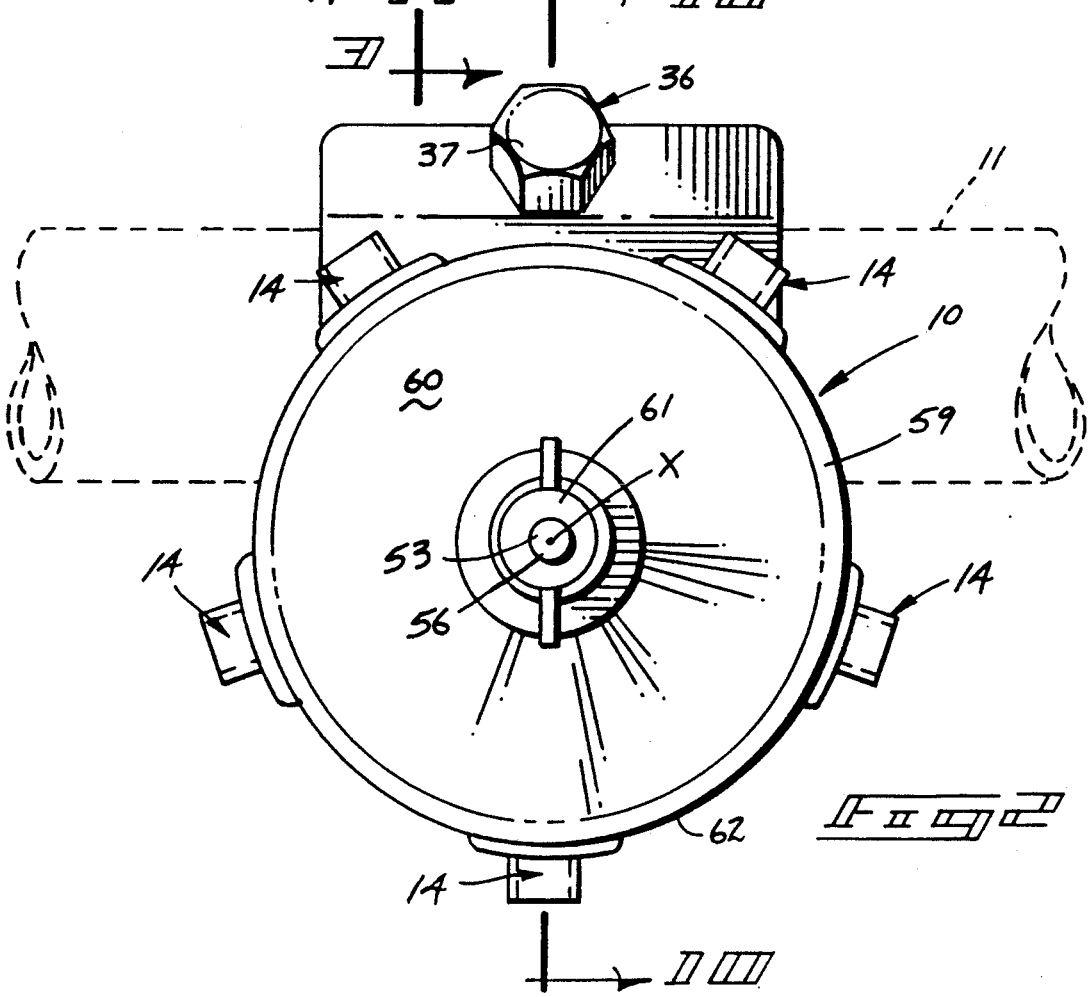
FIG. 2 is a front elevation view thereof.

The following disclosure of the invention is submitted in furtherance with the constitutional purpose of the Patent Laws "to promote the progress of science and useful arts" (Article 1, Section 8).

The present nozzle selector device, generally designated in the drawings by reference numeral 10, is provided to facilitate fast and convenient selection of any one of several nozzles 14 to dispense fluid material from a common delivery tube 11. The device 10 provides a number of nozzles 14, any one of which may be easily shifted to an operative position for delivering fluid from the tube 11. The present device 10 is provided in a simple and efficient construction to facilitate minimal leakage of fluid during use. It is also constructed to facilitate ease of disassembly for maintenance or replacement purposes.

The present nozzle selector device 10 may be mounted at spaced locations along fluid supply tube 11 to discharge fluid such as conventional fertilizer, as in commonly used in tractor drawn or self propelled agricultural fertilizer, herbicide, and pesticide sprayers. Thus a plurality of the present devices 10 may be adapted to simply replace the various conventional nozzle fittings on a conventional boom sprayer (not shown).

Figure 7:
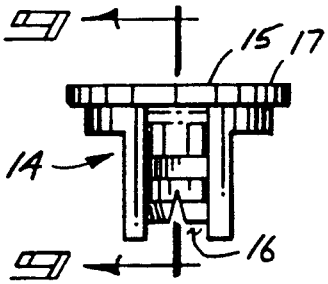
FIG. 7 is a side elevation view of a typical spray nozzle.
Figure 8:
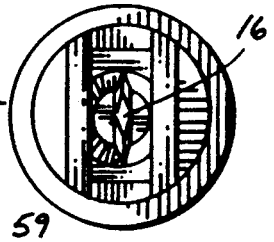
FIG. 8 is an end view of the nozzle.
Figure 9:
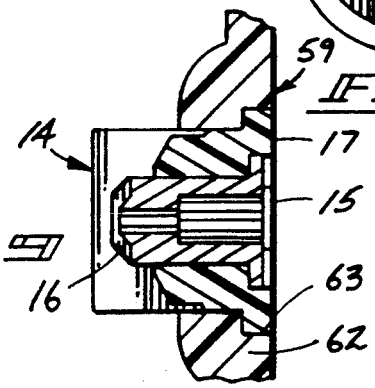
FIG. 9 is a fragmented sectional view showing the nozzle in place on the cover member.

The nozzles 14 are advantageously conventional spray nozzles as shown in FIGS. 7–9. Each includes an intake end 15, an outward discharge end 16, and a relatively flat flange surface 17 at the intake end 15, The nozzles 14 are removably mounted to the device by a movable cover member 59 which will be described in greater detail below.

The present flow selector device 10 preferably includes a rigid base 21 (FIG. 10). The base 21 may be constructed of injection molded plastic material. Other materials may also be utilized, provided that they are appropriately rigid and that they are corrosion resistant. Furthermore, the base 21 may be formed by methods of other than injection molding. However, it is believed that injection molding processes may best be utilized to form the base 21 in an efficient and cost effective manner.

The base 21 includes a mounting flange 22 to facilitate attachment to tube 11. A clamp plate 23 and mounting hardware 24 are used to secure the device directly to the tube 11 as a fluid supply source.

The base 21 is formed with an internal chamber 27. The chamber 27 is defined in part by an at least partially circular wall 28. The wall 28 leads from a floor to an open top end of the chamber which is selectively spanned by the cover 59.

A conduit, generally shown at 32 (FIG. 10) is situated within the base 21. The conduit 32 in general provides fluid connection extending from one end 33 connected to the tube 11 and the contents thereof, to a remaining end 34 for releasable, sealed connection to a selected nozzle 14 of the group provided on the cover 59.

At the one end 33, the conduit includes a nipple 35 that fits through an appropriate aperture within the tube 11. The conduit 32 thus openly communicates with the tube contents.

Immediately downstream of the end 33 and within the base 21 is a valve 36. The valve 36 includes a cap 37 on the base 21 covering an opening into the conduit 32. Under the removable cap 37 is a spring 39 and a ball 38 (FIG. 10). The spring 39 normally urges the ball 38 toward a closed position, seated against the base 21 and stopping flow from the one conduit end 33 through the conduit 32. However upon application of a selected amount of pressure (say 10 psi) from within the tube 11, the spring pressure will be overcome and the valve 36 will open. The valve 36 is thus used as an automatic shut-off should pressure within the tube 11 drop below a prescribed (10 psi) value. The valve 36 thus enables positive control of discharge through the present device 10.

Figure 6:
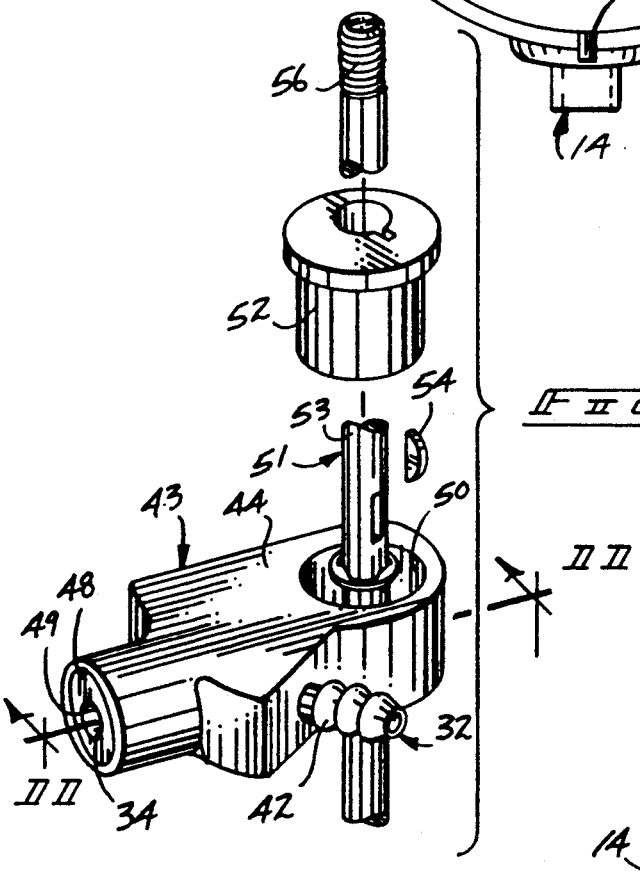
FIG. 6 is a partially exploded perspective view of a preferred clamp arm utilized in the present invention.

The conduit 32 also includes a flexible tube 40 that extends from the valve 36 inwardly to a passage 45 formed through a clamp member 43 on the base. The passage 45 leads from a hose barb 42 (FIGS. 6 and 11), connecting the tube 40, to the remaining conduit end 34.

A filter 47 (FIGS. 10, 11) is provided within the clamp member 43 adjacent the remaining conduit end 34. The filter 47 is fitted within a complimentary recess within the clamp arm 44. It is removably held in place within the conduit by a sealing gasket or ring 48 removably fitted to the clamp arm end. The gasket or sealing ring 48 provides a seal between the conduit 32 and the nozzle 14 presently aligned with the remaining conduit end 34, through selective operation of the clamp member 43.

Gasket or seal ring 48 may be formed of an sealing resilient material such as rubber, neoprene or another resilient, corrosion resistant material commonly used for sealing purposes in chemical applications.

Figure 11:
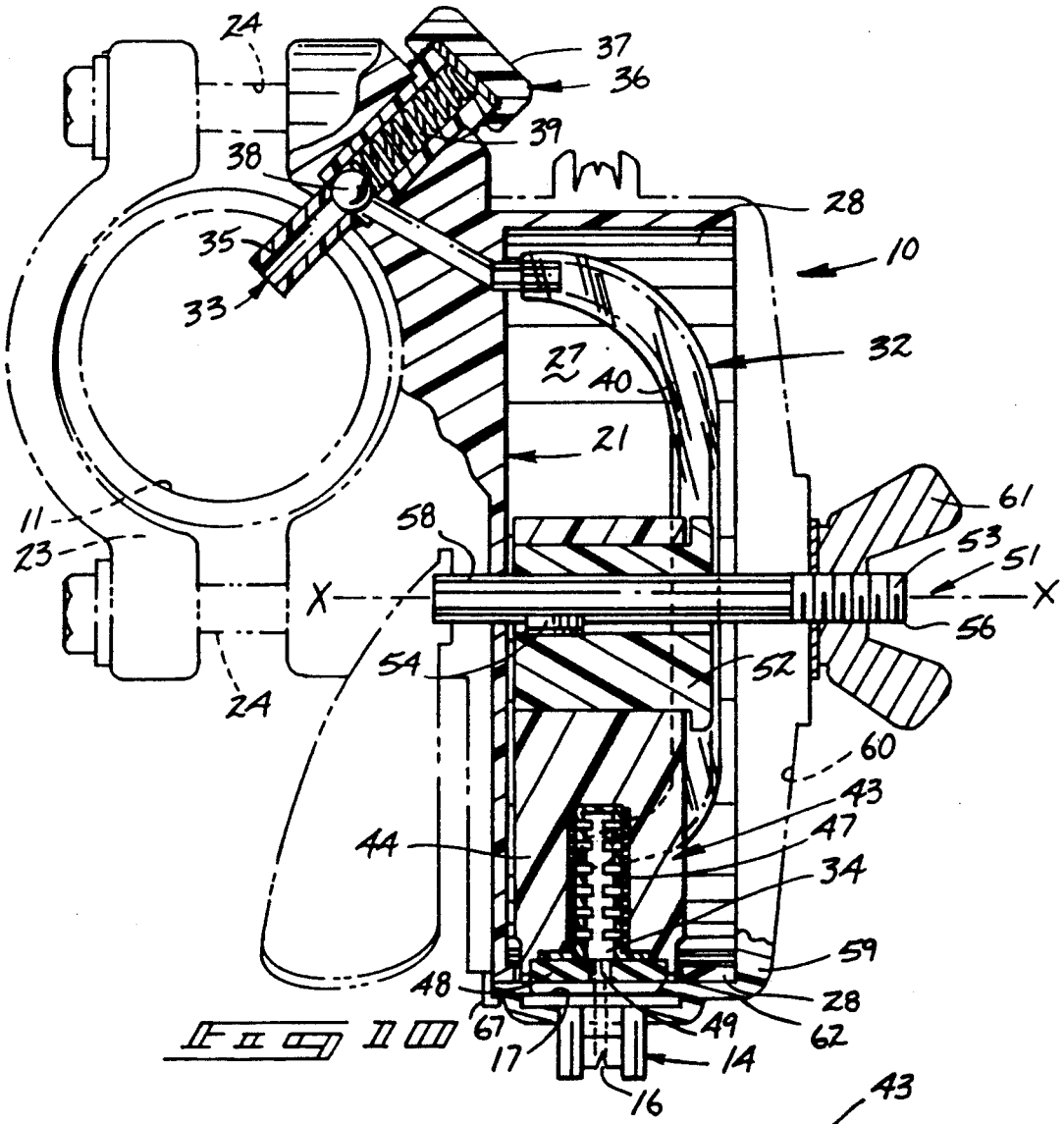
FIG. 11 is an enlarged sectional view taken substantially along line 11—11 in FIG. 9.
Figure 12:
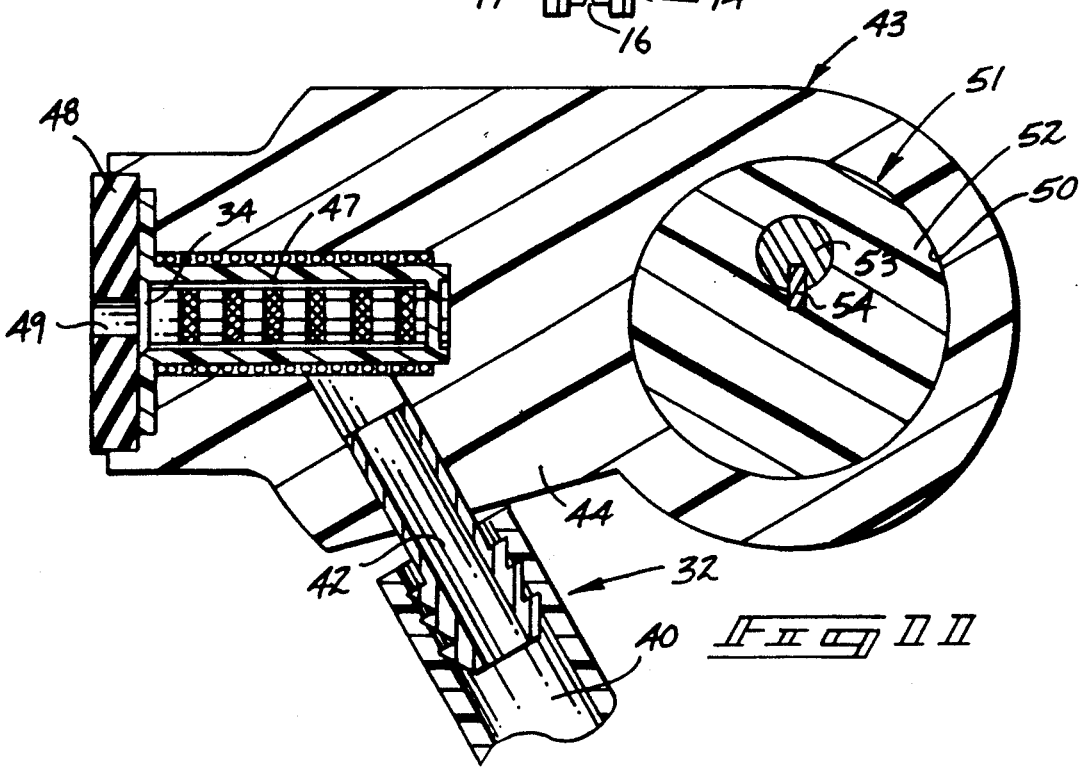

As shown in FIGS. 10–11, the seal ring 48 is substantially centered on the conduit end 34. The seal ring 48 is formed with a central opening 49 aligned with the conduit open end 34. Fluid will thus pass freely through the seal opening 49, while the body of the seal effectively (and selectively) seals the conduit 32 to the adjacent nozzle 14 (FIG. 10).

Figure 3:
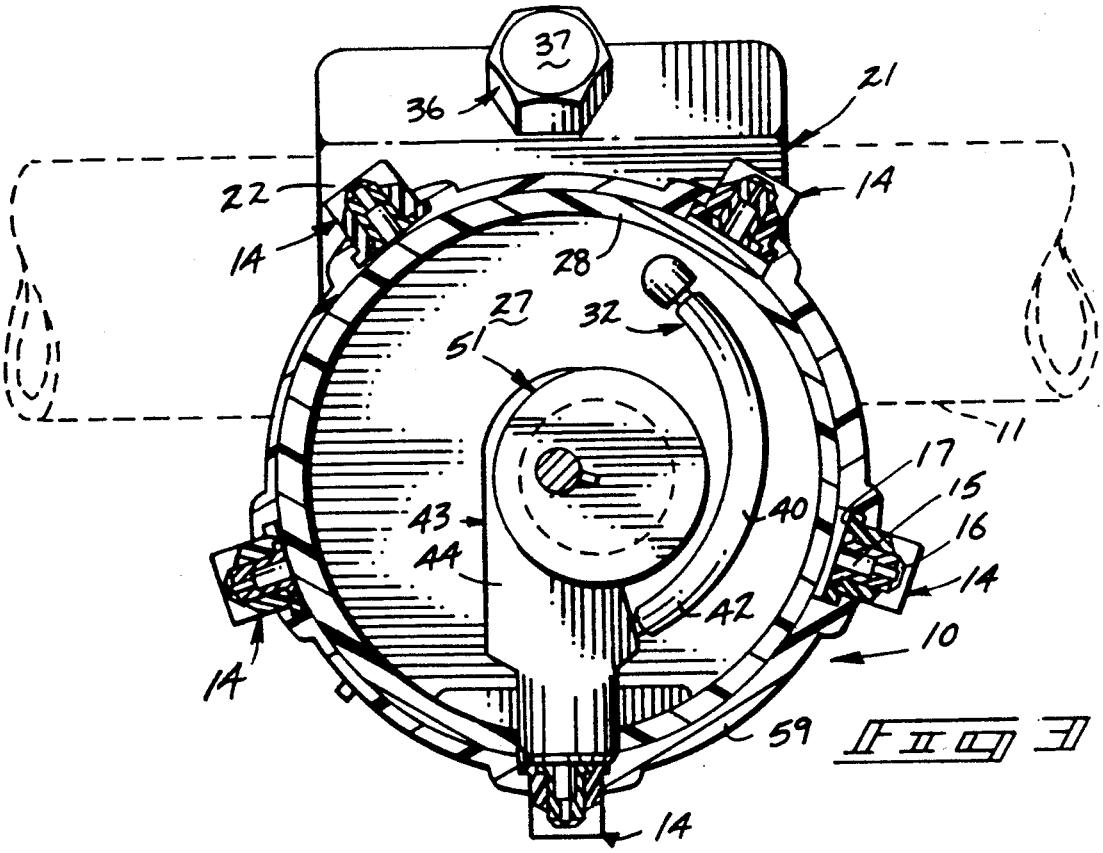
FIG. 3 is a sectional view taken along line 3—3 in FIG. 1.
Figure 4:
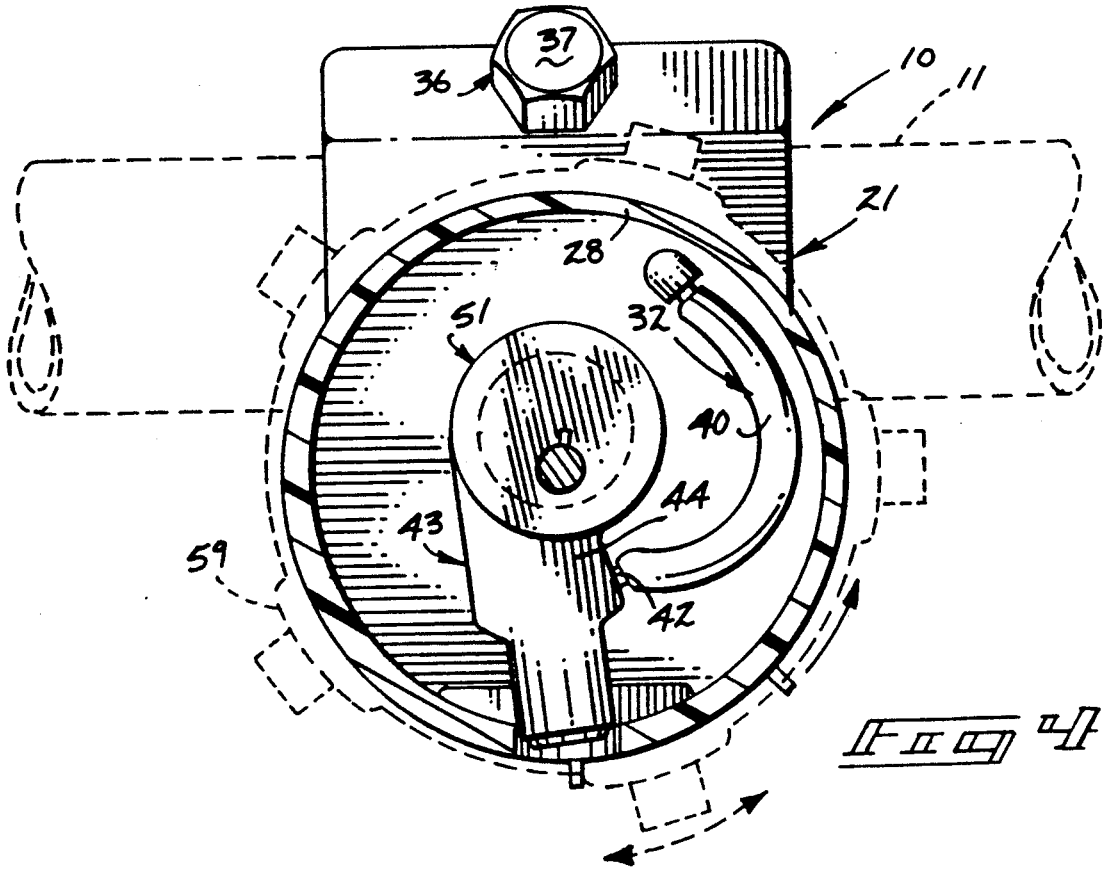
FIG. 4 is a view similar to FIG. 3 only showing a different operative position of the components thereof and with the cover and nozzles shown in dashed lines.
Figure 5:
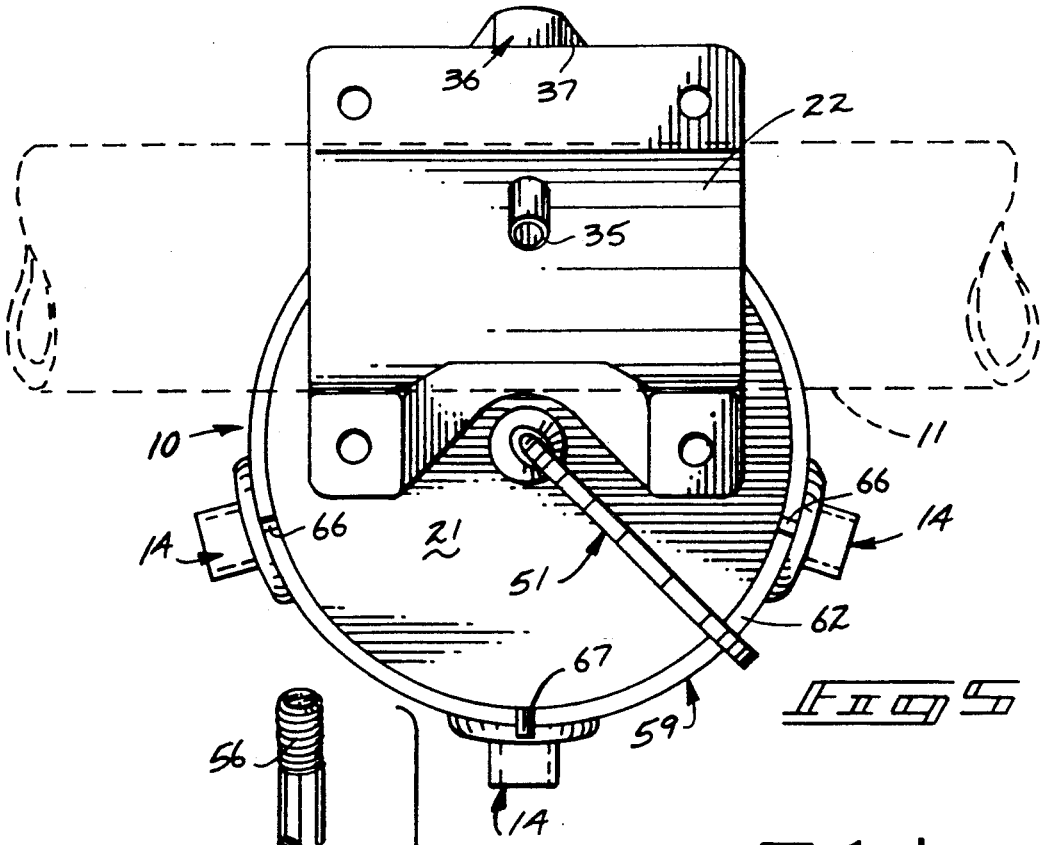
FIG. 5 is a rear elevation view thereof.

The clamp arm 44, through which the conduit 32 passes, is provided for selective movement within the base between an operative clamping position and an inoperative release position (FIGS. 3 and 4 respectively). Such movement facilitates selective connection and disconnection of the conduit end 34 to a selected one of the nozzles 14. This motion is afforded through an operator 51 which is shown in detail in FIGS. 3–5, 9 and 10.

The operator 51 includes an eccentric cam 52, rotatably positioned within the base and slidably received within a bore 50 (FIGS. 6, 11) extending through the clamp arm 44. The eccentric cam 52 is mounted to a shaft or hub 53 for rotation about axis X that may be coaxial with the central axis of the chamber 27. A key 54 is provided between the shaft or hub 53 and cam 52 so the two elements will rotate together.

The shaft or hub 52 extends axially through the base 21 and cover 59 on axis X. Both ends of the shaft or hub 53 project outwardly from the base 21. The top end 56 projects upwardly through a hole in the cover 59 and the bottom end 58 projects downwardly through a hole provided in the base.

The top end 56 of the shaft is threaded to receive a wing nut 61. The bottom end 58 of the shaft 53 mounts a selector lever 57 to facilitate manual rotation of the shaft 53 and cam 52. The lever 57 extends laterally for hand access.

Selective operation of the lever 57 will cause the cam 52 to rotate and forcibly move the clamp arm 44 between an operative, clamping position and an inoperative release position. In the clamping position, the clamp arm 44 forcibly presses the seal ring 48 against a selected nozzle 14 on the cover 59, sealing the conduit 32 to the nozzle. In the release position, the seal ring 48 is separated from the nozzle 14 to facilitate movement of the cover 59 to bring another nozzle 14 into position for use.

A preferred form of clamp member 43 has been described above. It should be noted, however that other forms may be used, including those disclosed in our prior U.S. Pat. No. 4,869,285, portions of which relate to various alternative clamp mechanisms are hereby incorporated by reference into this application.

With any of the clamp forms identified above and incorporated by reference herein, the nozzles 14 and cover 59 may be easily and quickly removed from the base 21 to facilitate cleaning, or replacement of one or more nozzles.

Cover 59 may be formed in the same manner and of the same material as base 21. Cover 59 includes a peripheral circular wall 62 (FIG. 10) that mounts the various nozzles 14 in a common plane transverse to the axis X. A preferred cover wall 62 is substantially cylindrical and slidably received over the base wall 28 to rotate thereon about the axis X. The wall 62 is spanned by a top wall 60 to effectively close the chamber 27 against dust or debris when the cover 59 is in place.

The cover wall 62 and the base wall 28 are substantially coaxial and are held together at their common axes by the central operator hub or shaft 53. The cover 59 may be removed from the base simply by removing the wing nut 61 from the shaft or hub 53 and lifting the cover off the base. This frees the cover to facilitate interchanging of the nozzles 14, if desired.

The cover wall 62 also includes a number of openings 63 (FIG. 9) for releasably recieving an equal number of nozzles 14. The nozzles 14 are simply pressed through the openings 63, with their flanged intake ends 17 butting against adjacent surfaces of the cover. The nozzles 14 are mounted with the discharge ends 16 facing radially outward with respect to the axis X. The flat range surfaces 17 thus face inwardly for selective sealed abutment with the sealing ring 48 of the clamp member 43.

The cover wall 62 includes a notch 66 (FIGS. 1, 5) on the rim of its wall 62 for each of the nozzles 14. The notches 66 are provided to recieve a mating alignment pin 67 on the base 21 so any one of the nozzles 14 may be accurately aligned with the conduit end 32.

Prior to operation, if necessary, a set of selected nozzles 14 representing a selected desired size range may be selected and mounted to cover 59. This is done simply by removing the cover 59 and fitting the selected group of nozzles through the appropriate openings 63 in the cover wall 62. The cover 59 may then be easily slipped back onto the base 21 with care being taken to engage the cover notch 66 with the mating pin 67 in the base. This assures proper registry between a selected nozzle 14 and the conduit 32. The wing nut may now be placed at the upward end of the shaft or hub 53 in a loose manner to allow rotation of the cover member 59.

Operation of the present invention to selectively align a selected nozzle 14 with the open end 34 of the conduit 32 may now be easily and quickly accomplished.

Firstly the wing nut 61 may be left loose on the operator 46. If previously tightened, the wing nut 61 is first loosened to facilitate rotation of the cover 59 and operation of the lever 57.

The lever 57 should also be rotated to shift the clamp arm 44 from the operative position (FIG. 8) to an inoperative position (FIG. 9) This is done simply by shifting the lever 57 selectively to rotate the eccentric cam 52. The cam 52, rotating in a prescribed direction will cause corresponding movement of the clamp are 44 to seperate the seal 48 from the nozzle 14 currently adjacent thereto. The cover is now free to rotate about the axis X.

With the wing nut and clamp means thus loosened, the cover 59 can be easily rotated to bring a nozzle 14 of selected size into alignment with the associated notch 66 recieving the pin 67 on the base. The selected nozzle 14 is now in alignment with the conduit 32.

After the proper nozzle 14 is selected, the user may rotate the lever 57 to shift the clamp member into the operative position. The rotating eccentric cam 52 causes movement of the clamp arm 44 to bring the seal 48 firmly into flush, sealed engagement with the flat flange surface 17 of the selected nozzle 14. The conduit 32 is thus securely sealed to the nozzle 14 and will be held in open communication therewith while fluid is delivered thereto from the tube 11. Sufficient pressure may be exerted by the cam to tightly secure the selected nozzle 14 by the seal to thereby prevent leakage.

The eccentric cam 52 may be moved to a slightly over-center position (FIG. 4) to effective lock the clamp arm 44 in the operative position until the lever 57 is again operated to shift the clamp arm 44 to the open inoperative position. Once the clamp arm 44 is moved to the operative position, the wing nut 61 may be tightened to secure the cover in position, thereby further preventing rotation of the cover 59.

The above described device is extremely simple to operate and very reliable. The simple mechanical provisions described herein enable a user to quickly and easily join a selected nozzle 14 to the conduit 32 without requiring removal and replacement of the nozzles 14 from the selector device.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A nozzle selector device for connection to a fluid source to discharge fluid from the source through a selected nozzle, comprising:

a base a conduit mounted to the base and having one end adapted to be connected to the fluid source and a remaining end;

a clamp member mounting the remaining end of the conduit to the base for selective movement between an operative clamping position and an inoperative release position;

a seal on the clamp member at the remaining end of the conduit, the seal having a central opening to pass flow from the conduit;

a cover including a substantially circular wall including a central axis and mounted to the base and rotatable thereon about the central axis;

a plurality of nozzles mounted to the substantially circular wall, each having a discharge end facing outward of the wall and an intake end oriented toward the base, the nozzles being positioned in relation to the clamp member such that any selected nozzle of the plurality may be selectively rotated about the central axis into alignment with the clamp member; and an operator on the base connected to the clamp member for selectively shifting the clamp member between the operative clamping position wherein the seal is pressed against the intake end of the selected nozzle currently in alignment with the clamp member so the conduit is joined in a sealed relationship to the selected nozzle to deliver fluid thereto, and the inoperative release position in which the clamp member and seal are separated and the cover is free to be rotated.

2. The nozzle selector device for connection to a fluid source to discharge fluid from the source through a selected nozzle as defined by claim 1 further comprising:

a valve in the base responsive to pressure within the conduit to open and allow flow through the conduit at pressures above a certain level and to close and block fluid flow through the conduit at pressures below said certain level.

3. The nozzle selector device for connection to a fluid source to discharge fluid from the source through a selected nozzle as defined by claim 1 wherein the nozzles are removably mounted to the cover.

4. The nozzle selector device for connection to a fluid source to discharge fluid from the source through a selected nozzle as defined by claim 1 wherein the cover includes a cover wall formed about the central axis, and wherein the nozzles are removably mounted to the cover wall.

5. The nozzle selector device for connection to a fluid source to discharge fluid from the source through a selected nozzle as defined by claim 1 wherein the cover includes a cover wall formed about the central axis and parallel thereto, and wherein the nozzles are removably mounted to the cover wall with discharge ends thereof oriented radially outwardly with respect to the central axis.

6. The nozzle selector device for connection to a fluid source to discharge fluid from the source through a selected nozzle as defined by claim 1 wherein the cover includes a cylindrical cover wall formed about the central axis.

7. The nozzle selector device for connection to a fluid source to discharge fluid from the source through a selected nozzle as defined by claim 1 further comprising:

a valve in the base responsive to pressure within the conduit to open and allow flow through the conduit at pressures above a certain level and to close and block fluid flow through the conduit at pressures below said certain level; and wherein the cover includes a cover wall formed about the central axis and wherein the nozzles are removably mounted to the cover wall with discharge ends thereof oriented radially outwardly with respect to the axis.

8. The nozzle selector device for connection to a fluid source to discharge fluid from the source through a selected nozzle as defined by claim 1 wherein the base includes a base wall with at least a portion thereof circular and coaxial with the central axis.

* * * * *